US011690417B2

(12) United States Patent
Bologna et al.

(10) Patent No.: US 11,690,417 B2
(45) Date of Patent: Jul. 4, 2023

(54) WOVEN BREATHABLE TEXTILE

(71) Applicant: NIKE, Inc., Beaverton, OR (US)

(72) Inventors: Jennifer G. Bologna, Beaverton, OR (US); Scott K. Hutsenpiller, Portland, OR (US); Duncan Hou, New Taipei (TW)

(73) Assignee: NIKE, Inc., Beaverton, OR (US)

( * ) Notice: Subject to any disclaimer, the term of this patent is extended or adjusted under 35 U.S.C. 154(b) by 544 days.

(21) Appl. No.: 16/582,198

(22) Filed: Sep. 25, 2019

(65) Prior Publication Data

US 2020/0107599 A1 Apr. 9, 2020

Related U.S. Application Data

(60) Provisional application No. 62/740,689, filed on Oct. 3, 2018.

(51) Int. Cl.
*D03D 11/02* (2006.01)
*A41D 31/02* (2019.01)
(Continued)

(52) U.S. Cl.
CPC ..... *A41D 31/02* (2013.01); *D03D 1/00* (2013.01); *D03D 9/00* (2013.01); *D03D 13/004* (2013.01);
(Continued)

(58) Field of Classification Search
CPC ..... A41D 31/06; A41D 31/065; D03D 9/00; D03D 13/00; D03D 13/004; D03D 11/02; D10B 2403/023
See application file for complete search history.

(56) References Cited

U.S. PATENT DOCUMENTS 2,631,290 A 3/1953 Klepper
3,228,821 A 1/1966 Trope
(Continued)

FOREIGN PATENT DOCUMENTS

CN 104413702 A 3/2015
CN 204812094 U 12/2015
(Continued)

OTHER PUBLICATIONS

Smith "7 Weave Patterns to Know—Twill, Basketweave, Satin, and More". Retrieved from https://www.heddels.com/2017/12/7-weave-patterns-to-know-twill-basketweave-satin-and-more/ (Year: 2017).*
(Continued)

*Primary Examiner* — Andrew T Piziali
(74) *Attorney, Agent, or Firm* — Shook, Hardy & Bacon L.L.P.

(57) ABSTRACT

Aspects herein are directed to a woven, breathable textile. The textile comprises a first woven zone and a second woven zone, where the first and second woven zones are integrally woven such that a particular warp yarn extends through both the first woven zone and the second woven zone of the textile. The first woven zone comprises a first woven layer and a second woven layer with a space or void formed between the first and second woven layers. The second woven zone comprises a single woven layer comprising a plurality of apertures formed through the weaving process, where each aperture is located at the center of a repeating pattern of interlacings.

10 Claims, 7 Drawing Sheets

(51) Int. Cl.

| | |
|---|---|
| ***D03D 15/00*** | (2021.01) |
| ***D03D 1/00*** | (2006.01) |
| ***D03D 15/283*** | (2021.01) |
| ***D03D 9/00*** | (2006.01) |
| ***D03D 13/00*** | (2006.01) |
| *A41D 31/102* | (2019.01) |

(52) U.S. Cl.
CPC ..... *D03D 15/00* (2013.01); *D03D 15/283* (2021.01); *A41D 31/102* (2019.02); *A41D 2500/20* (2013.01); *D10B 2501/04* (2013.01)

(56) References Cited

U.S. PATENT DOCUMENTS

| | | | | |
|---|---|---|---|---|
| 3,805,720 | A | 4/1974 | Hunt | |
| 3,839,756 | A | 10/1974 | Hibbert et al. | |
| 3,878,574 | A | 4/1975 | Erickson | |
| 4,194,041 | A | 3/1980 | Allen, Jr. et al. | |
| 5,181,287 | A | 1/1993 | Yang | |
| 5,415,924 | A | 5/1995 | Herlihy, Jr. | |
| 5,692,245 | A | 12/1997 | Reuben | |
| 5,987,669 | A | 11/1999 | Leggett et al. | |
| 6,389,850 | B1 * | 5/2002 | Fujiwara | D04B 21/207 66/171 |
| 8,578,516 | B2 | 11/2013 | Li | |
| 9,392,825 | B2 | 7/2016 | Pezzimenti et al. | |
| 2002/0016984 | A1 | 2/2002 | Poholski | |
| 2004/0131830 | A1 | 7/2004 | Davidson et al. | |
| 2004/0175532 | A1 | 9/2004 | Rainbolt | |
| 2005/0172378 | A1 | 8/2005 | Messiou | |
| 2008/0075850 | A1 | 3/2008 | Rock | |
| 2009/0089911 | A1 | 4/2009 | Smith | |
| 2009/0155543 | A1 | 6/2009 | Fowler | |
| 2009/0325445 | A1 | 12/2009 | Bogdan et al. | |
| 2012/0288662 | A1 | 11/2012 | Conolly | |
| 2013/0177731 | A1 | 7/2013 | Moriarty | |
| 2014/0349057 | A1 | 11/2014 | Blackford et al. | |
| 2015/0218737 | A1 * | 8/2015 | Blakely | A41D 31/102 428/131 |
| 2017/0099898 | A1 * | 4/2017 | Pezzimenti | A41B 9/00 |

FOREIGN PATENT DOCUMENTS

| | | | |
|---|---|---|---|
| CN | 205125111 | U | 4/2016 |
| CN | 206744618 | U | 12/2017 |
| CN | 107780018 | A | 3/2018 |
| JP | 7-145532 | A | 6/1995 |
| KR | 10-1582550 | B1 | 1/2016 |
| TW | M490488 | U | 11/2014 |
| WO | 1992011780 | A1 | 7/1992 |
| WO | 2014087161 | A1 | 6/2014 |

OTHER PUBLICATIONS

Tepar "Draw Textured (DTY) Yarns". Retrieved from http://www.tepar.com/sites/1/upload/files/Tepar_Draw_Textured_Yarns-53.pdf (Year: 2016).*

International Search Report and Written Opinion received for PCT Patent Application No. PCT/US2019/053378, dated Jan. 20, 2020, 10 pages.

International Preliminary Report on Patentability received for PCT Patent Application No. PCT/US2019/053378, dated Apr. 15, 2021, 9 pages.

SAGE journals, "Transport properties of multi layer fabric based on electrospun nanofiber mats as a breathable barrier textile material". http://journals.sagepub.com/doi/abs/10.1177/0040517511420766?journalCode=trjc.

Journal of Engineered Fibers and Fabrics, "Multilayered Breathable Fabric Structures with Enhanced Water Resistance" Ilhan Ozen. http://www.jeffjournal.org/papers/Volume7/7.4.10l.Ozen.pdf.

Intention to Grant received for European Patent Application No. 19790352.9, dated Dec. 13, 2022, 7 pages.

* cited by examiner

X= WARP YARN RAISED

BLANK= WARP YARN DOWN

WOVEN BREATHABLE TEXTILE

CROSS-REFERENCE TO RELATED APPLICATIONS

This application, assigned U.S. application Ser. No. 16/582,198, filed Sep. 25, 2019, and entitled "Woven Breathable Textile" claims the benefit of priority of U.S. Prov. App. No. 62/740,689, filed Oct. 3, 2018, and entitled "Woven Breathable Textile." The entirety of the aforementioned application is incorporated by reference herein.

TECHNICAL FIELD

Aspects herein are directed to a woven, breathable textile that, when incorporated into a garment, provides insulation and breathability.

BACKGROUND

Traditional ways of creating insulated garments include creating chambers through, for example, stitching panels of material together and blowing down or other synthetic fibers into the chambers. This often requires a lot of material and may create material waste. Moreover, traditional insulated garments may trap moisture vapor produced by the wearer which may result in wearer discomfort.

BRIEF DESCRIPTION OF THE DRAWINGS

Examples of the present invention are described in detail below with reference to the attached drawing figures, wherein.

DETAILED DESCRIPTION

Figure 1:
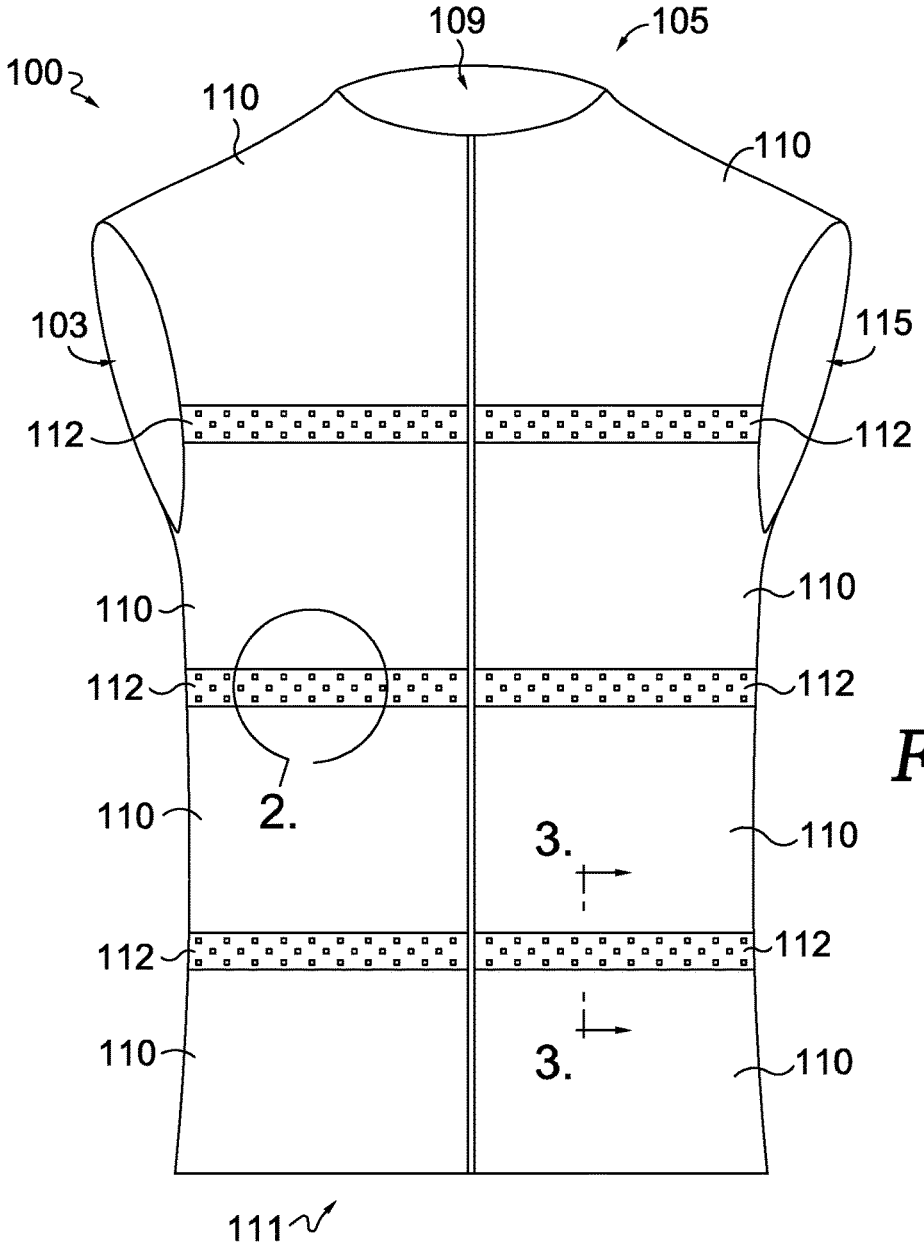
FIG. 1 illustrates a front view of an example garment incorporating a woven breathable textile in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a woven, breathable textile that may be incorporated into a garment or other types of apparel items. The woven, breathable textile, in example aspects, comprises at least a first woven zone and a second woven zone, where the first and second woven zones are integrally woven such that, for instance, a particular warp yarn extends through both the first woven zone and the second woven zone of the textile. The first woven zone comprises a first woven layer and a second woven layer with a space or void formed between the first and second woven layers. When incorporated into, for example, a garment, the space or void may be filled with a thermally insulating fill material such as down or a synthetic fill (e.g., polyfill fibers, polyfill sheets, or nonwoven sheets). Continuing, the second woven zone comprises a single woven layer having a plurality of apertures formed through the weaving process. More particularly, each aperture is located at a center of a repeating pattern of interlacings. In example aspects, the woven, breathable textile may comprise a plurality of first woven zones and a plurality of second woven zones. For instance, the woven, breathable textile may comprise a repeating pattern of a first woven zone, a second woven zone, a first woven zone, a second woven zone, and the like.

A garment or apparel item incorporating the woven textile is configured to provide both insulation and breathability. For instance, the use of a thermally insulating fill material in the space formed between the first and second woven layers of the first woven zone helps to provide an insulative effect to the garment. The garment may be particularly suited for a wearer exercising in cold- or cool-weather conditions. In these conditions, the wearer may release moisture in the form of perspiration. The provision of apertures in the second woven zone of the woven textile allows for moisture from perspiration to escape to the outer environment helping the wearer to stay comfortable, warm, and dry.

Accordingly, aspects herein are directed to a woven textile comprising a first woven zone having a first woven layer and a second woven layer, where the second woven layer is positioned adjacent to the first woven layer to define a space between the first woven layer and the second woven layer. The woven textile further comprises a second woven zone having a plurality of apertures, where each aperture is located at a center of a repeating pattern of interlacings. The repeating pattern of interlacings comprises: 1) a first quadrant having at least one float on a first face of the woven textile, the at least one float formed from a first filling yarn, 2) a second quadrant having at least one float on the first face formed from a first warp yarn, 3) a third quadrant having at least one float on the first face formed from a second filling yarn, and 4) a fourth quadrant having at least one float on the first face formed from a second warp yarn. The first quadrant and the third quadrant are positioned diagonal with respect to one another and are separated by a respective aperture of the plurality of apertures, and the second quadrant and the fourth quadrant are positioned diagonal with respect to one another and are separated by the respective aperture.

Aspects herein are further directed to a garment comprising at least one woven panel. The woven panel comprises a first woven zone having a first woven layer and a second woven layer, where the second woven layer is positioned adjacent to the first woven layer to define a space between the first woven layer and the second woven layer, and where the first woven zone is formed using a plurality of warp yarns and a first plurality of filling yarns. The woven panel further comprises a second woven zone having a plurality of apertures, where each aperture is located at a center of a repeating pattern of interlacings using the plurality of warp yarns and a second plurality of filling yarns. The repeating pattern of interlacings comprises: 1) a first quadrant having at least one float on a first face of the woven panel, the at least one float formed from a first filling yarn of the second plurality of filling yarns, 2) a second quadrant having at least one float on the first face formed from a first warp yarn of the plurality of warp yarns, 3) a third quadrant having at least one float on the first face formed from a second filling yarn of the second plurality of filling yarns, and 4) a fourth quadrant having at least one float on the first face formed from a second warp yarn of the plurality of warp yarns. The first quadrant and the third quadrant are positioned diagonal with respect to one another and separated by a respective aperture of the plurality of apertures, and the second quadrant and the fourth quadrant are positioned diagonal with respect to one another and separated by the respective aperture. The woven panel additionally comprises a thermally insulating fill material contained within the space between the first woven layer and the second woven layer.

In yet another aspect, a method of manufacturing a woven textile is provided. The method comprises weaving a first woven zone using a first plurality of warp yarns and a first plurality of fillings yarns, where weaving the first woven zone comprises weaving a first woven layer and weaving a second woven layer such that the second woven layer is positioned adjacent to the first woven layer to define a space therebetween. The method additionally comprises weaving a second woven zone using the first plurality of warp yarns and a second plurality of filling yarns, where the second woven zone is woven to have a plurality of apertures, and where each aperture located at a center of a repeating pattern of interlacings. The repeating pattern comprises: 1) a first quadrant having at least one float on a first face of the woven textile, the at least one float formed from a first filling yarn of the second plurality of filling yarns, 2) a second quadrant having at least one float on the first face formed from a first warp yarn of the plurality of warp yarns, 3) a third quadrant having at least one float on the first face formed from a second filling yarn of the second plurality of filling yarns, and 4) a fourth quadrant having at least one float on the first face formed from a second warp yarn of the plurality of warp yarns. The first quadrant and the third quadrant are positioned diagonal with respect to one another and separated by a respective aperture of the plurality of apertures, and where the second quadrant and the fourth quadrant are positioned diagonal with respect to one another and separated by the respective aperture.

The term "yarn" as used herein may comprise any type of filament yarn such as a monofilament yarn or a multifilament yarn that forms a continuous strand. The term yarn may also mean an assemblage of fibers twisted or laid together so as to form a continuous strand. The term "weaving" as used herein means a process by which yarns are interlaced at right angles. As used herein, the term "interlacing" may be defined as the point at which a yarn changes its position from one side or one face of the textile to the other side or other face of the textile. The term "float" as used herein may be defined as a yarn that crosses over more than one yarn at a time before changing position to the other side or face of the textile.

Continuing, the components of a woven textile as described herein comprise warp yarns and filling (or weft) yarns, where the warp yarns extend in the lengthwise direction of the textile (i.e., parallel to the selvedge) and the filling yarns extend in the cross-wise direction of the textile. In one example aspect, the warp yarns may comprise 75 denier/72 filament DTY (draw texturized yarn) polyester yarns, and the filling yarns may comprise 50 denier/72 filament DTY polyester yarns although other denier/filament ratios are contemplated herein for the warp yarns and the filling yarns.

The term "integrally woven" as used herein means that the first and second woven zones are woven during a single weaving event. As such, the first and second woven zones share at least a common warp yarn. The present disclosure contemplates a number of different types of looms used to weave the woven textile such as air-jet looms, rapier looms, water-jet looms, projectile looms, multi-width or multi-beam looms, multiple-shed looms, circular looms, Jacquard looms, dobby looms, and the like. In example aspects, the weaving loom may comprise a water jet dobby loom. In other example aspects, the weaving loom may comprise a high warp count single beam Jacquard loom and/or a double beam Jacquard loom. With respect to the high warp count single beam Jacquard loom, in example aspects, the beam warping process utilizes approximately 2,750 warp yarns on eight different smaller warp beams that are combined to form a single warp beam having a full width of 22,000 warp yarns.

Positional terms used herein such as "superior," "inferior," "medial," "lateral," "upper," "lower," "side," "front," "back," "horizontal," "vertical," "diagonal," "outer-facing surface," "inner-facing surface," and the like are to be given their common meaning with respect to a garment or apparel item incorporating the woven, breathable textile being worn as it is intended to be worn by a hypothetical wearer standing in an upright position (i.e., standing in anatomical position) as shown and described herein. For instance, the "front" of a garment is configured to cover a front torso area, a front arm area, and/or a front leg area of a wearer, and the "back" of the garment is configured to cover a back torso area, a back arm area, and/or a back leg area of the wearer. Further, the phrase "configured to contact," or other similar phrases used when describing different portions of the garment or apparel item in relation to a wearer refer to a garment or apparel item appropriately sized for the particular wearer.

Figure 4:
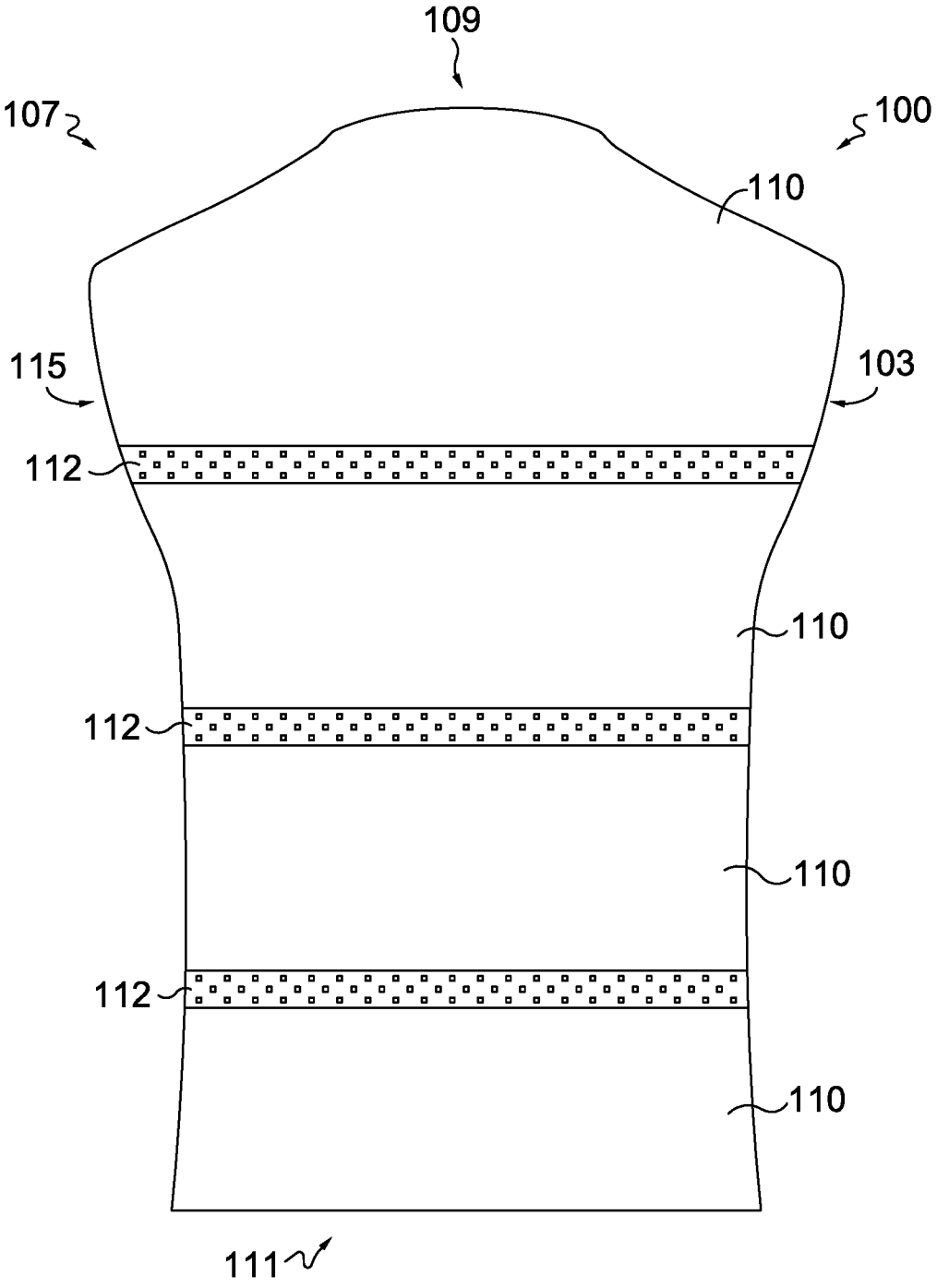
FIG. 4 illustrates a rear view of the example garment of FIG. 1 in accordance with aspects herein.

Turning now to FIGS. 1 and 4, front and rear views respectively of a garment 100 formed from a woven, breathable textile are illustrated in accordance with aspects herein. The garment 100 comprises a front portion 105 (seen in FIG. 1) and a back portion 107 (seen in FIG. 4) that together define at least a neck opening 109, a waist opening 111, a first sleeve opening 103, and a second sleeve opening 115. The garment 100 is shown in the form of a sleeveless vest, but it is contemplated herein that the garment 100 may take the form of a jacket, coat, pullover, hoodie, a body suit, and the like each having full sleeves, three-quarter sleeves, half-sleeves, quarter sleeves, removable sleeves, no sleeves, and the like. The garment 100 may comprise a stand-alone garment meant to be worn over one or more base layers or over the wearer's skin. Or the garment 100 may be part of a garment system such that one or more additional layers (e.g., an outer shell layer) may be worn over the garment 100. When configured to be worn under, for instance, an outer shell layer, the garment 100 may be releasably or permanently fastened to the outer shell using, for example, zippers or other slider mechanisms, buttons, hook-and-loop fasteners, stitching, and the like. Any and all aspects, and any variation thereof, are contemplated as being within aspects herein.

Continuing, although the garment 100 is shown as being entirely formed from the woven, breathable textile, it is contemplated herein that the woven, breathable textile may be incorporated as one or more garment panels. In this aspect, portions of the garment not formed from the woven, breathable textile may comprise other textiles such as knit textiles, nonwoven textiles, or even woven textiles having a different weave construction than the woven, breathable textile described herein. Moreover, although not shown, it is also contemplated herein that the woven, breathable textile may be incorporated into and/or form other apparel items such as shoes, hats, bags (duffel bags, backpacks), and the like. Any and all aspects, and any variation thereof, are contemplated as being within aspects herein.

Figure 2:
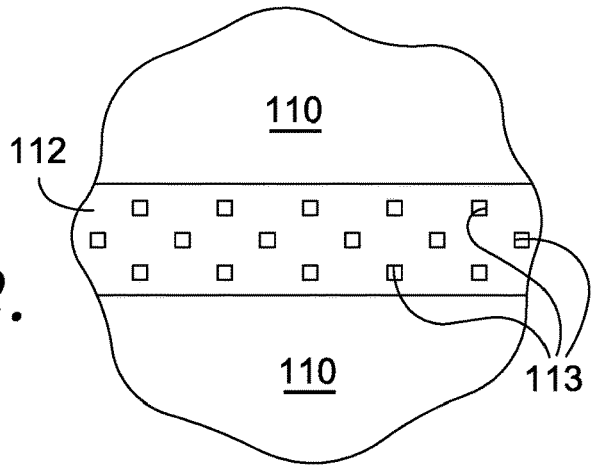
FIG. 2 illustrates a close-up view of the woven breathable textile taken at the area indicated in FIG. 1 in accordance with aspects herein.

The garment 100 comprises several first woven zones 110 and several second woven zones 112. A close-up view of the second woven zone 112 is shown in FIG. 2. As shown in FIG. 2, the second woven zone 112 comprises a plurality of apertures 113. A more detailed view of the first and second woven zones 110 and 112 will be provided in FIG. 3. Returning to FIGS. 1 and 4, in example aspects, the first woven zones 110 and the second woven zones 112 form an alternating and repeating pattern such that the second woven zones 112 generally separate the first woven zones 110 from each other, and the first woven zones 110 generally separate the second woven zones 112 from each other.

The first and second woven zones 110 and 112 extend throughout the front portion 105 and the back portion 107 of the garment 100. However, it is also contemplated herein, that the first and second woven zones 110 and 112 may be limited to one or more sub-portions of the front portion 105 and/or the back portion 107 of the garment 100 (just the upper front, just the upper back, just the lower front, just the lower back, just the sleeves when present, and the like). For instance, placement of the first and second woven zones 110 and 112 on the garment 100 may be based on where insulation needs and/or breathability needs are the greatest. As an example, at least the upper chest region of a wearer may be exposed to prevailing winds when, for instance, the wearer is running. Based on this, insulation needs may be greater in this area. However, this area is also a high sweat-producing area (based on, for example, sweat maps of the human body). Thus, breathability and permeability needs are also greater in this area. By positioning the first and second woven zones 110 and 112 in this area, both insulation and breathability/permeability is achieved. For example, by positioning the second woven zones 112 in areas with greater breathability and permeability needs, moisture vapor produced by the wearer may escape through the apertures 113 in the second woven zone 112, and air from the external environment may enter the garment 100 via the apertures 113 and promote evaporation of the moisture vapor remaining on the wearer's garment(s) and/or skin.

Although each of the first woven zones 110 and the second woven zones 112 is shown as generally having a generally consistent width as measured from, for example, a first edge of the first and second woven zones 110 and 112 to a second edge of the first and second woven zones 110 and 112, it is contemplated herein, that the widths of the first and/or second woven zones 110 and/or 112 may be adjusted to customize the amount of insulation and/or breathability needed in certain areas of the garment 100. For example, the width of the first woven zone 110 may be increased in areas of the garment 100 needing higher amounts of insulation and may be decreased in areas needing relatively low amounts of insulation. Similarly, the width of the second woven zone 112 may be increased in areas of the garment 100 positioned adjacent to high heat or sweat producing areas of a wearer and may be decreased in areas of the garment 100 positioned adjacent to low heat or sweat producing areas.

Further, although each of the first woven zones 110 and the second woven zones 112 is shown as generally having a horizontal orientation on the garment 100 (i.e., the lengthwise direction of the first and second woven zones 110 and 112 extends between the first sleeve opening 105 and the second sleeve opening 115), it is contemplated herein that the first and second woven zones 110 and 112 may be skewed from this horizontal orientation. For example, the garment 100 may be formed such that the warp yarns of the woven, breathable textile are oriented vertically (e.g., in a direction extending from the neck opening 109 to the waist opening 111) causing the first and second woven zones 110 and 112 to have the orientation shown in FIGS. 1 and 4. Or the garment 100 may be formed such that the warp yarns of the woven, breathable textile are oriented horizontally (e.g., in a direction extending from the first sleeve opening 103 to the second sleeve opening 115) causing the first and second woven zones 110 and 112 to have a lengthwise vertical orientation extending between the neck opening 109 and the waist opening 111.

Continuing, in yet another aspect, the woven, breathable textile may be incorporated into the garment 100 on the bias such that the warp yarns and the filling yarns are at, for instance, a generally 45 degree angle to, for example, a line extending from an inferior margin of the first sleeve opening 103 to the waist opening 111 (e.g., 45 degrees to a side seam joining the front portion 105 to the back portion 107) or at a 45 degree angle to a line extending from the neck opening 109 to the waist opening 111. When the woven, breathable textile is incorporated into the garment 100 on the bias, the first and second woven zones 110 and 112 may be positioned at a corresponding 45 degree angle on the garment 100. Although a 45 degree angle is described, it is also contemplated herein that the woven, breathable textile may be incorporated on the bias at angles less than or more than 45 degrees such as between 5 degrees and 85 degrees causing the first and second woven zones 110 and 112 to assume corresponding angles. Any and all aspects, and any variation thereof, are contemplated as being within aspects herein.

Figure 3:
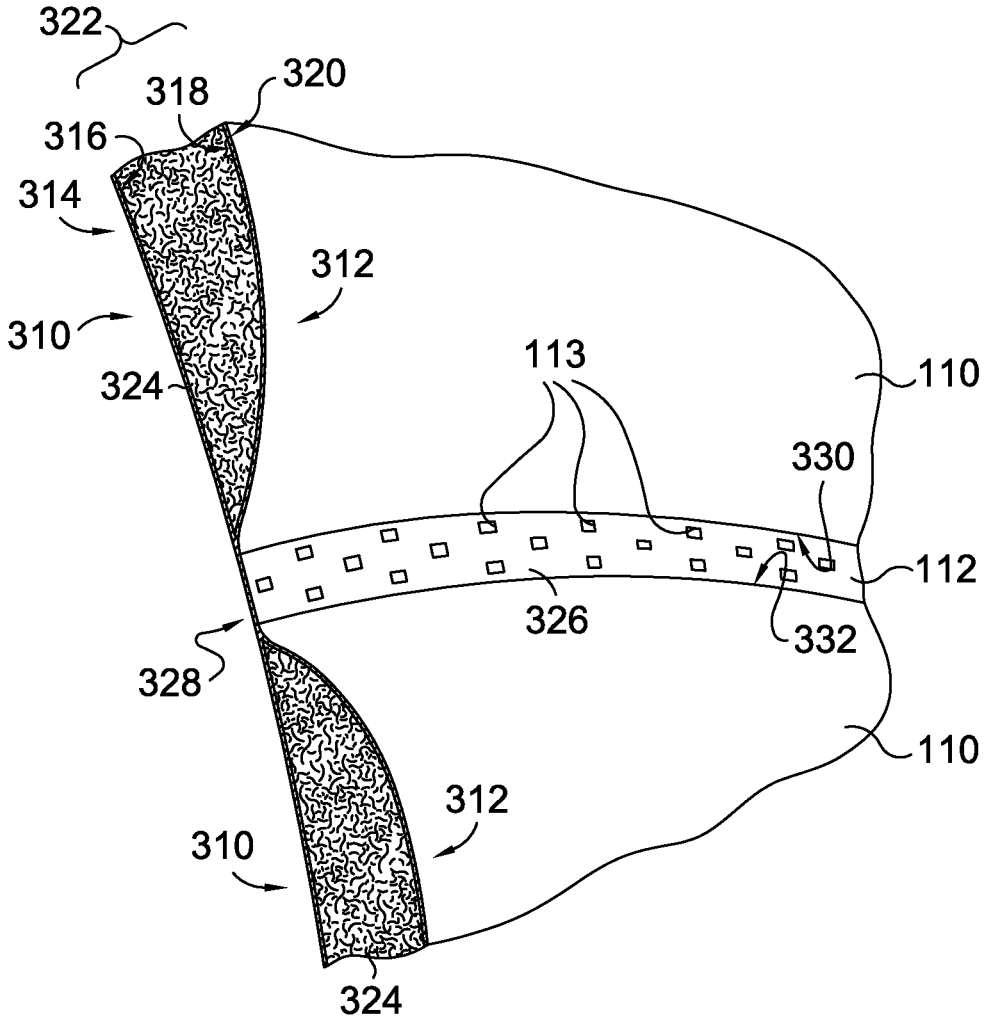
FIG. 3 illustrates a perspective cross-sectional view of the woven breathable textile taken at the area indicated in FIG. 1 in accordance with aspects herein.

As described above, each of the first woven zones 110 comprises a first woven layer and a second woven layer. A space or void is formed between the first woven layer and the second woven layer, and the space or void may be filled with a thermally insulating fill material. This is shown more clearly in FIG. 3, which depicts a perspective cross-sectional view taken along cut line 3-3 of FIG. 1. FIG. 3 depicts a portion of first woven zones 110 separated by a second woven zone 112. As shown in the cross-sectional view, each of the first woven zones 110 comprises a first woven layer 310 and a second woven layer 312. The first woven layer 310 comprises a first surface 314 and a second surface 316 opposite the first surface 314. The second woven layer 312 comprises a third surface 318 and a fourth surface 320 opposite the third surface 318.

The first and second woven layers 310 and 312 are woven such that the second surface 316 of the first woven layer 310 is positioned adjacent to the third surface 318 of the second woven layer 312 to define a space 322 therebetween. In example aspects, and as shown in FIG. 3, the space 322 may be filled with a thermally insulating fill material 324. The thermally insulating fill material 324 may comprise down, loose synthetic fibers, synthetic sheets (polyfill sheets, non-woven sheets), and the like. The first surface 314 of the first woven layer 310 may comprise an inner-facing surface of the garment 100 (i.e., a surface configured to face toward a body surface of a wearer (or an inner base layer)), while the fourth surface 320 of the second woven layer 312 may comprise an outer-facing surface of the garment 100 (i.e. a surface configured to face toward an external environment (or an outer shell layer)).

The second woven zone 112 is integrally woven with the first woven zones 110 such that the second woven zone 112 shares at least one common warp yarn with the first woven zones 110. However, the second woven zone 112, in contrast to the first woven zones 110, comprises a single woven layer as shown in FIG. 3. The single woven layer of the second woven zone 112 comprises a first face 326 and a second face 328 opposite the first face 326. In example aspects, the first face 326 of the second woven zone 112 comprises an outer-facing surface of the garment 100, and the second face 328 of the second woven zone 112 comprises an inner-facing surface of the garment 100.

In example aspects, each of the first woven layer 310 and the second woven layer 312 of the first woven zone 110 may comprise a fabric count of 75 by 50 (i.e., 75 warp yarns and 50 filling yarns per square centimeter), and the second woven zone 112 may also comprise a fabric count of 75 by 50 although other fabric counts are contemplated herein. In example aspects, achieving the same fabric count in the second woven zone 112 and in the first woven layer 310 and the second woven layer 312 of the first woven zone 110 may be achieved by using one or more additional weft feeders when forming the first woven layer 310 and the second woven layer 312 and by dropping out some of the warp yarns when forming the second woven zone 112. The fabric counts as described herein help to prevent the fill material contained between the first woven layer 310 and the second woven layer 312 from sticking out or poking through the first and second woven layers 310 and 312. Use of the fabric counts as described herein, moreover, helps to provide a degree of weather resistance to the woven, breathable textile and also provides a uniform surface for the application of, for example, a durable water repellant.

The second woven zone 112 may comprise a first edge 330 spaced apart from a second edge 332 opposite the first edge 330, where both the first and second edges 330 and 332 extend along a length of the second woven zone 112. The first edge 330 may comprise a line of demarcation indicating where the first woven zone 110 transitions to the second woven zone 112. In other words, the first edge 330 indicates where the woven, breathable textile transitions from a two-layer construction to a single-layer construction. In a similar manner, the second edge 332 may comprise a line of demarcation indicating where the second woven zone 112 transitions to the first woven zone 110. In other words, the second edge 332 indicates where the woven, breathable textile transitions from a single-layer construction to a two-layer construction. In example aspects, the apertures 113 are distributed throughout the second woven zone 112 in a regular, repeating pattern as described more fully below. That is, the apertures 113 are located between the first edge 330 and the second edge 332 of the second woven zone 112 in a regular, repeating pattern. Further, the apertures 113 extend from the first face 326 through the second face 328 of the second woven zone 112 such that they comprise through passages through which moisture vapor and/or air may pass. The size of the apertures 113 is illustrative only and it is contemplated herein that the apertures 113 may be smaller or larger in size than that shown.

Figure 5:
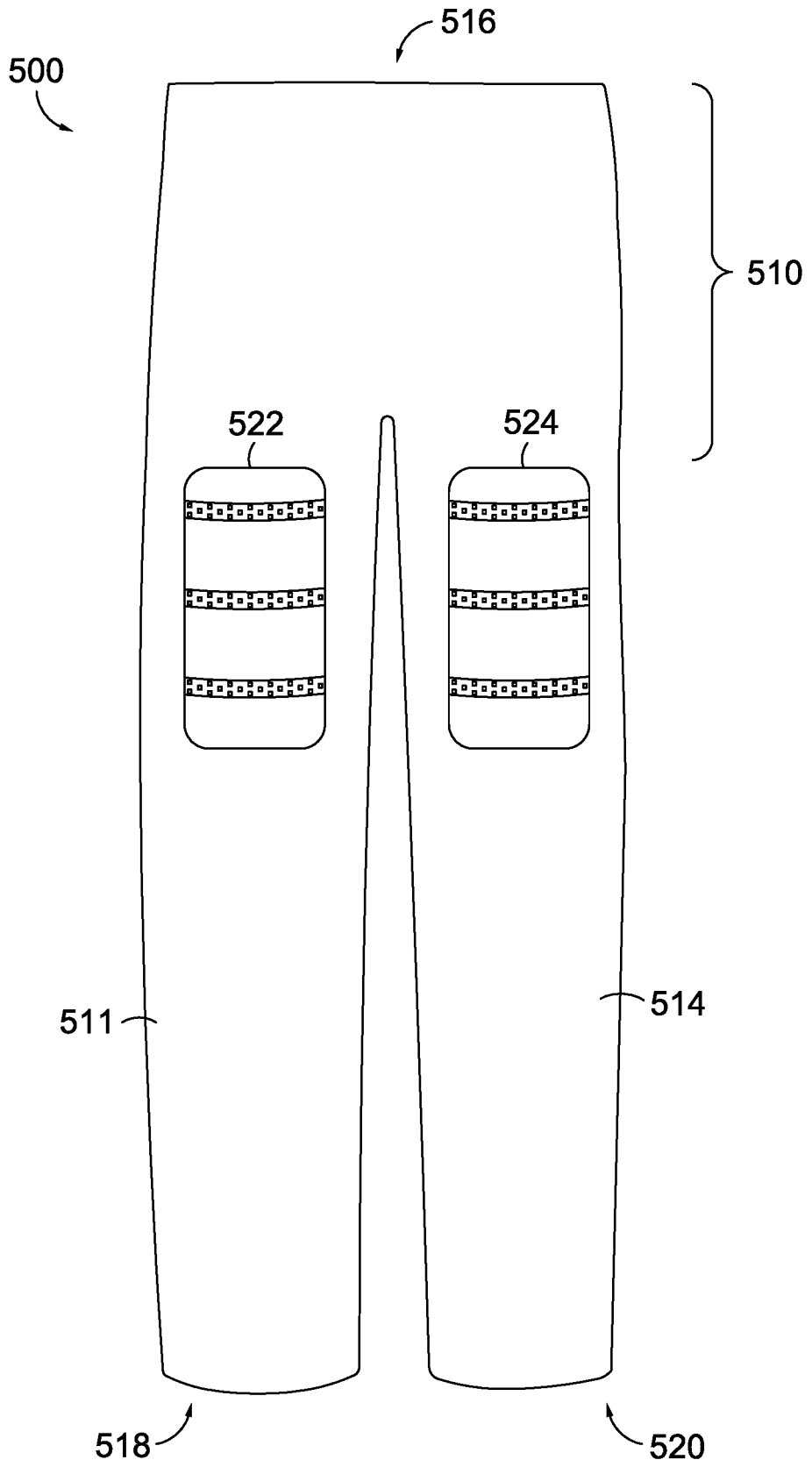
FIG. 5 illustrates a front view of another example garment incorporating the woven breathable textile in accordance with aspects herein.

FIG. 5 illustrates a front view of a lower-body garment 500 and is used to illustrate that the woven, breathable textile described herein may be incorporated into a garment as a panel. The lower-body garment 500 is shown in the form of a pair of pants, although it is contemplated herein that the lower-body garment 500 may be in the form of capris, shorts, tights, and the like. The lower-body garment 500 comprises a torso portion 510 having a front aspect and a back aspect (not shown), a first leg portion 511, and a second leg portion 514. The torso portion 510 defines a waist opening 516, and each of the first and second leg portions 511 and 514 define respective leg openings 518 and 520.

Instead of being used to form the whole lower-body garment 500, the woven, breathable textile described herein may be incorporated in select locations as panels 522 and 524. For example, in one example aspect, an opening may be formed in the lower-body garment 500 for each panel 522 and 524 where the shape of the opening corresponds to the perimeter shape of the panels 522 and 524. The perimeter edges of the panels 522 and 524 may then be affixed to the openings in the lower-body garment 500 using affixing technologies such as stitching, adhesives, bonding, welding, and the like. In this example, the lower-body garment 500 may be formed from one type of textile such as a knit textile, a nonwoven textile, or a woven textile having a different weave construction, while the panels 522 and 524 comprise the woven, breathable textile described herein.

In another example aspect, the lower-body garment 500 and the panels 522 and 524 may be integrally woven with each other (i.e., share at least one common warp yarn or filling yarn). In this aspect, the portions of the lower-body garment 500 not comprising the panels 522 and 524 may comprise a first type of weave structure (e.g., a twill weave or satin weave), while the panels 522 and 524 comprise the weave construction described below in relation to FIGS. 6-9. Any and all aspects, and any variation thereof, are contemplated as being within aspects herein.

The panels 522 and 524 may be incorporated into the lower-body garment 500 at select locations depending on insulation and breathability needs. In the aspect shown in FIG. 5, the panels 522 and 524 are located in an upper, front thigh area of the lower-body garment 500. This area may experience a high amount of wind flow when, for example, worn by a wearer who is running. Moreover, the large muscle groups in this area may produce a high amount of heat and/or sweat. By positioning the panels 522 and 524 in this location, insulation is provided while still allowing for moisture vapor to escape and also allowing some air exchange with the external environment to provide a local cooling effect. The location of the panels 522 and 524 is illustrative only, and it is contemplated herein that the panels 522 and 524 may be positioned at other locations on the lower-body garment 500 depending on the particular insulation and breathability needs of the garment. As well, it is contemplated herein that the panels may be utilized in other types of garments and article such as an upper-body garment, a hat, gloves, and the like. Any and all aspects, and any variation thereof, are contemplated as being within aspects herein.

Figure 6:
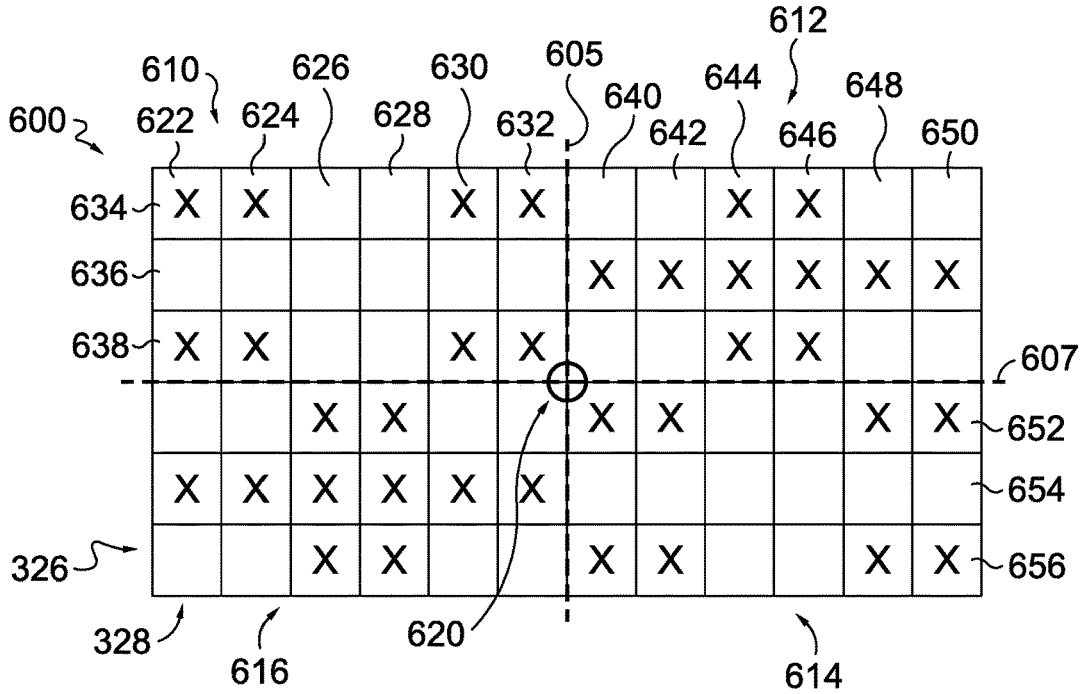
FIG. 6 illustrates an example weave pattern including a repeating pattern of interlacings at a second woven zone of the example woven textile in accordance with aspects herein.

Turning now to FIG. 6, a weave diagram is depicted illustrating the weave pattern for the second woven zone 112 described herein. As previously described, the second woven zone 112 comprises a plurality of apertures, such as the apertures 113, where each aperture is located at a center of a repeating pattern of interlacings. This repeating pattern of interlacings is shown in FIG. 6 and is referenced generally by the numeral 600. In FIG. 6, the "X" represents a warp yarn in an up position on the first face 326 of the second woven zone 112, and a blank represents a warp yarn in a down position on the first face 326 of the second woven zone 112. As is known in the art of weaving, warp yarns extend between a warp beam and a fabric beam. The warp yarns are raised and lowered via a hamess-heddle arrangement. When some of the warp yarns are raised while the remaining warp yarns remain in a down position, a shed or space is formed through which the filling yarns are inserted. As such, to describe the weave diagram of FIG. 6 in a different way, each "X" represents a warp yarn on the first face 326 of the second woven zone 112, and each blank represents a filling yarn on the first face 326 of the second woven zone 112. The second face 328 of the second woven zone 112 would comprise the reverse of the pattern seen on the first face 326 of the second woven zone 112.

With this as background, the repeating pattern 600 can hypothetically be divided into four quadrants by a vertical line 605 that vertically bisects the repeating pattern 600 into generally equal right and left sides and by a horizontal line 607 that horizontally bisects the repeating pattern 600 into generally equal top and bottom halves. The quadrants comprise a first quadrant 610, a second quadrant 612, a third quadrant 614, and a fourth quadrant 616. The quadrants 612, 614, 616, and 618 intersect at the center of the repeating pattern 600 as indicated by the reference numeral 620 and a circle. To describe it a different way, the center 620 of the repeating pattern 600 is located where the vertical line 605 intersects the horizontal line 607. As will be shown more clearly in FIG. 7, the center 620 comprises the area where an aperture is located after the yarns have been pushed or packed into place.

With respect to the first quadrant 610, the first quadrant 610 may comprise, for example, six warp yarns 622, 624, 626, 628, 630, and 632 and three filling yarns 634, 636, and 638. The warp yarns and the filling yarns are interlaced such that at least the filling yarn 636 comprises a float yarn that extends over the warp yarns 622, 624, 626, 628, 630, and 632 on the first face 326 of the second woven zone 112.

With respect to the second quadrant 612, the second quadrant 612 may comprise an additional six warp yarns 640, 642, 644, 646, 648, and 650 and the same three filling yarns 634, 636, and 638 as are in the first quadrant 610 of the repeating pattern 600. That is, the filling yarns 634, 636, and 638 extend through both the first quadrant 610 and the second quadrant 612 either on the first face 326 of the second woven zone 112 or on the second opposite face 328 of the second woven zone 112. The warp yarns and the filling yarns are interlaced in the second quadrant 612 such that at least the warps yarns 644 and 646 comprise float yarns that extend over the filling yarns 634, 636, and 638 on the first face 326 of the second woven zone 112. To describe the repeating pattern 600 in the second quadrant 612 in a different way, the filling yarn 636 that comprises a float yarn that extends over the warp yarns 622, 624, 626, 628, 630, and 632 on the first face 326 of the second woven zone 112 in the first quadrant 610 now is positioned under the warp yarns 640, 642, 644, 646, 648, and 650 in the second quadrant 612. As such, in the second quadrant 612, the filling yarn 636 comprises a float yarn that extends over the warp yarns 640, 642, 644, 646, 648, and 650 on the second face 328 of the second woven zone 112.

With respect to the third quadrant 614, the third quadrant 614 may comprise the same set of warp yarns as in the second quadrant 612. That is, the third quadrant comprises warp yarns 640, 642, 644, 646, 648, and 650. As such, the warp yarns 640, 642, 644, 646, 648, and 650 extend through both the second quadrant 612 and the third quadrant 614 either on the first face 326 of the second woven zone 112 or on the second opposite face 328 of the second woven zone 112. The third quadrant 614 comprises three filling yarns 652, 654, and 656. The warp yarns and the filling yarns are interlaced in the third quadrant 614 such that at least the filling yarn 654 comprises a float yarn that extends over the warp yarns 640, 642, 644, 646, 648, and 650 on the first face 326 of the second woven zone 112.

With respect to the fourth quadrant 616, the fourth quadrant 616 comprises the same six warp yarns 622, 624, 626, 628, 630, and 632 as the first quadrant 610. As such, the warp yarns 622, 624, 626, 628, 630, and 632 extend through both the first quadrant 610 and the fourth quadrant 616 either on the first face 326 or the second face 328 of the second woven zone 112. Further, the fourth quadrant 616 comprises the same three filling yarns 652, 654, and 656 as are in the third quadrant 614 of the repeating pattern 600. That is, the filling yarns 652, 654, and 656 extend through both the third quadrant 614 and the fourth quadrant 616. The warp yarns and the filling yarns are interlaced in the fourth quadrant 616 such that at least the warp yarns 626 and 628 comprise float yarns that extend over the filling yarns 652, 654, and 656 on the first face 326 of the second woven zone 112. To describe the repeating pattern 600 in the fourth quadrant 616 in a different way, the filling yarn 654 that comprises a float yarn that extends over the warp yarns 640, 642, 644, 646, 648, and 650 on the first face 326 of the second woven zone 112 in the third quadrant 614 now is positioned under the warp yarns 622, 624, 626, 628, 630, and 632 in the fourth quadrant 616. As such, in the fourth quadrant 616, the filling yarn 654 comprises a float yarn that extends over the warp yarns 622, 624, 626, 628, 630, and 632 on the second face 328 of the second woven zone 112.

In example aspects, the first quadrant 610 and the third quadrant 614 are located diagonal with respect to one another in the repeating pattern 600, and the second quadrant 612 and the fourth quadrant 616 are located diagonal with respect to one another in the repeating pattern 600.

Although twelve warp yarns and six filling yarns are collectively described as forming the repeating pattern 600, it is contemplated herein that there may be a greater or a fewer number of warp yarns and filling yarns in accordance with aspects therein. In either case, aspects herein contemplate that the first quadrant 610 comprises at least one float formed from a first filling yarn on the first face 326 of the second woven zone 112, that the second quadrant 612 comprises at least one float formed from a first warp yarn on the first face 326 of the second woven zone 112, that the third quadrant 614 comprises at least one float formed from a second filling yarn on the first face 326 of the second woven zone 112, and that the fourth quadrant 616 comprises at least one float formed from a second warp yarn on the first face 326 of the second woven zone 112.

To describe the repeating pattern 600 in a different way, aspects herein contemplate that the first quadrant 610 comprises at least one float formed from a first filling yarn on the first face 326 of the second woven zone 112, that the second quadrant 612 comprises at least one float formed from the first filling yarn on the second face 328 of the second woven zone 112, that the third quadrant 614 comprises at least one float formed from a second filling yarn on the first face 326 of the second woven zone 112, and that the fourth quadrant 616 comprises at least one float formed from the second filling yarn on the second face 328 of the second woven zone 112. With respect to this description, the first filling yarn spans the same number of warp yarns on the first face 326 in the first quadrant 610 and the second face 328 in the second quadrant 612, and the second filling yarn spans the same number of warp yarns on the first face 326 of the third quadrant 614 and the second face 328 of the fourth quadrant 616.

Figure 7:
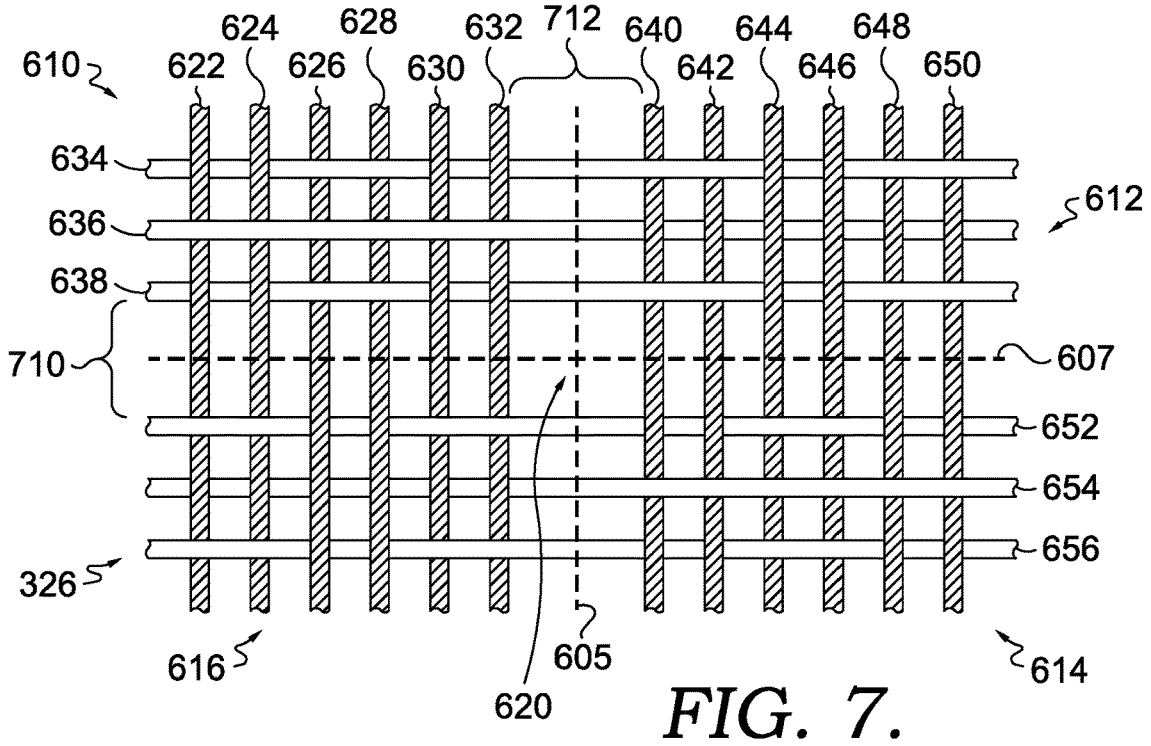
FIG. 7 illustrates the weave pattern of FIG. 6 using yarn representations in accordance with aspects herein.

A visual depiction of the repeating pattern 600 using yarns is shown in FIG. 7 in accordance with aspects herein. The same reference numerals provided in FIG. 6 are used in FIG. 7 to designate the warp yarns and the filling yarns. The warp yarns and the filling yarns are shown slightly spaced apart to better illustrate the repeating pattern 600. In reality, except where noted otherwise, the warp yarns and the filling yarns would be generally packed together to form a relatively tight weave structure.

As more clearly shown in FIG. 7, the center 620 of the repeating pattern 600 comprises an aperture (also referenced here by the numeral 620). The aperture 620 may be formed, at least in part, by packing, twisting, or beating the filling yarns 652, 654, and 656 after they have been inserted. In one example aspect, a reed or batten may be used to beat or push filling yarns in place. After being packed, the filling yarns 652, 654, and 656 are spaced apart from the filling yarns 634, 636, and 638 by a distance 710. Moreover, the dent pattern of the reed may be such that the warp yarns 622, 624, 626, 628, 630, and 630 are spaced apart from the warp yarns 640, 642, 644, 646, and 648 by a distance 712 to further form the aperture 620. As is shown in FIG. 7, the aperture 620 is at the center of the repeating pattern 600 such that the first quadrant 610 is diagonal to the third quadrant 614 with respect to the aperture 620, and the second quadrant 612 is diagonal to the fourth quadrant 616 with respect to the aperture 620.

Figure 8:
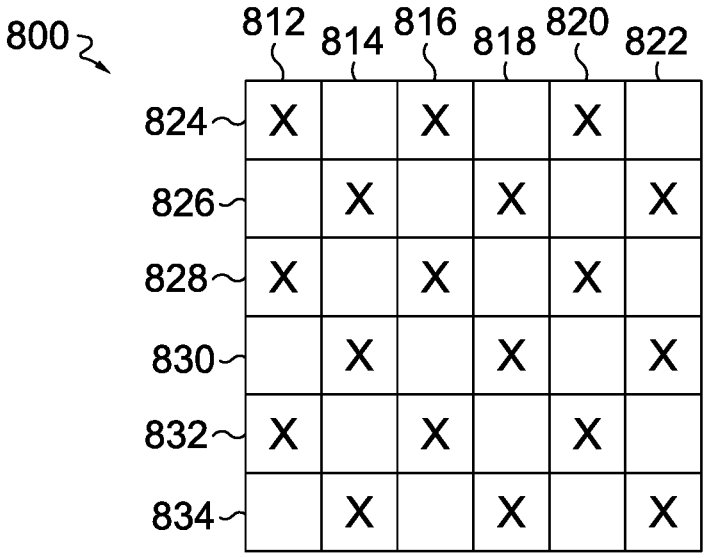
FIG. 8 illustrates an example weave pattern of a first woven zone of the example woven textile in accordance with aspects herein.

Turning now to FIG. 8, a weave diagram is depicted illustrating a weave pattern 800 for each of the first woven layer 310 and the second woven layer 312 of the first woven zone 110. Stated differently, the weave pattern 800 is used to weave both the first woven layer 310 and the second woven layer 312. As described above, a single beam Dobby loom may be used to weave the two different layers of the first woven zone 110. Alternatively, a double beam loom may be used to weave the first and second woven layers 310 and 312 of the first woven zone 110 as well as to weave the second woven zone 112. Each of the first and second woven layers 310 and 312 may comprise a plain weave pattern where each warp yarn interlaces with each filling yarn to form a maximum number of interlacings per given area. Because the first woven layer 310 comprises a separate and distinct layer from the second woven layer 312, it is contemplated herein that a first set of warp yarns and a first set of filling yarns are used to form the first woven layer 310 and a different set of warp yarns and a different set of filling yarns are used to form the second woven layer 312. To describe this in another way, it is contemplated herein that the first woven layer 310 does not share any warp yarns or any filling yarns with the second woven layer 312 such that they are separate from each other.

Similar to FIG. 6, each "X" in the weave diagram of FIG. 8 represents a warp yarn in an up position, and each blank represents a warp yarn in a down position. Thus, the weave diagram of FIG. 8 comprises warp yarns 812, 814, 816, 818, 820, and 822 and filling yarns 824, 826, 828, 830, 832, and 834. As shown, for example, the warp yarn 812 is interlaced with each of the filling yarns 824, 826, 828, 830, 832, and 834. The same is true for the remaining warp yarns 814, 816, 818, 820, and 822. To describe the weave pattern 800 in a different way, the weave pattern 800 does not comprise any float yarns.

Figure 9:
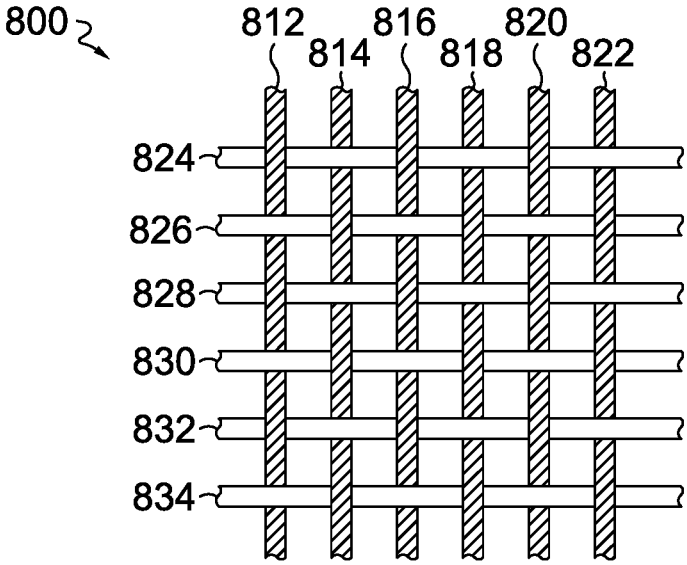
FIG. 9 illustrates the weave pattern of FIG. 8 using yarn representations in accordance with aspects herein.

FIG. 9 depicts the weave pattern 800 using yarns. The same reference numerals provided in FIG. 8 are used in FIG. 9 to designate the warp yarns and the filling yarns. The warp yarns and the filling yarns are shown slightly spaced apart to better illustrate the weave pattern 800. In reality, the warp yarns 812, 814, 816, 818, 820, and 822 and the filling yarns 824, 826, 828, 830, 832, and 834 would be generally packed together to form a relatively tight weaving structure. Although only six warp yarns and six filling yarns are shown in FIGS. 8 and 9, it is contemplated herein that the first and second woven layers 310 and 312 of the first woven zone 110 may comprise a plurality of warp yarns and a plurality of filling yarns sufficient so that the first woven zone 110 comprises a needed length and width.

Figure 10:
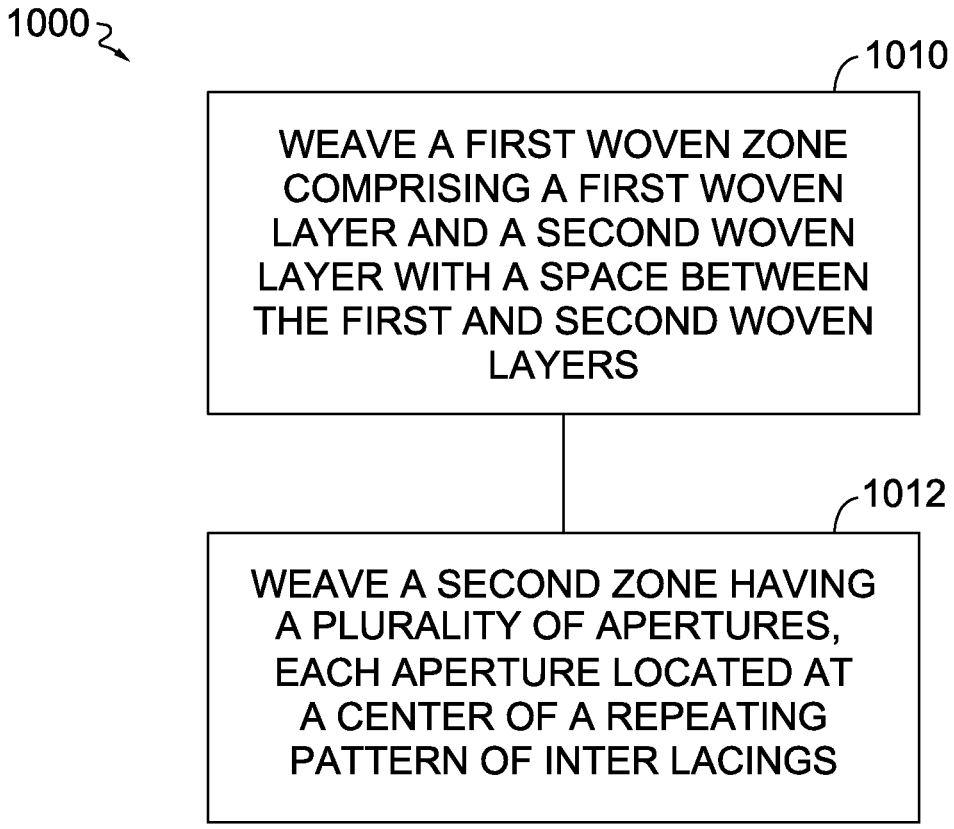
FIG. 10 illustrates a flow diagram of an example method of manufacturing a woven breathable textile in accordance with aspects herein.

Turning now to FIG. 10, a flow diagram of an example method 1000 of forming the woven, breathable textile described herein is provided. At a step 1010, a first woven zone, such as the first woven zone 110, is woven using a first plurality of warp yarns and a first plurality of filling yarns. The first woven zone is formed by simultaneously weaving a first woven layer, such as the first woven layer 310, and weaving a second woven layer, such as the second woven layer 312, so that a surface of the second woven layer is positioned adjacent to a surface of the first woven layer to define a space between the two surfaces. In example aspects, the first woven layer is woven in a plain weave pattern, such as the weave pattern 800, using a first subset of the first plurality of warp yarns and a first subset of the first plurality of filling yarns. Similarly, the second woven layer is also woven in a plain weave pattern, such as the weave pattern 800, using a second subset of the first plurality of warp yarns and a second subset of the first plurality of filling yarns.

At a step 1012, a second woven zone, such as the second woven zone 112, is woven using at least a portion of the first plurality of warp yarns and a second plurality of filling yarns. The second woven zone is woven to have a plurality of apertures, such as the aperture 113, where each aperture is located at a center of a repeating pattern of interlacings, such as the repeating pattern 600. In example aspects, the repeating pattern comprises a first quadrant, such as the first quadrant 610, having at least one float formed from a first filling yarn of the second plurality of filling yarns on the first face of the woven textile. The repeating pattern further comprises a second quadrant, such as the second quadrant 612, having at least one float formed from a first warp yarn of the portion of the first plurality of warp yarns on the first face of the woven textile. Continuing, the repeating pattern additionally comprises a third quadrant, such as the third quadrant 614, having at least one float formed from a second filling yarn of the second plurality of filling yarns on the first face of the woven textile. The repeating pattern also comprises a fourth quadrant, such as the fourth quadrant 616, having at least one float formed from a second warp yarn of the portion of the first plurality of warp yarns on the first face of the woven textile. In the repeating pattern, the first quadrant and the third quadrant are positioned diagonal with respect to one another and are separated by the respective aperture. And the second quadrant and the fourth quadrant are positioned diagonal with respect to one another and are also separated by the respective aperture.

Continuing with respect to the method 1000, the method 1000 may further comprise incorporating the woven textile into a garment and filling the space between the first and second woven layers with a thermally insulating fill material such as down, synthetic fibers, a polyfill sheet, air, and the like.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A woven textile comprising:

a first woven zone comprising a first woven layer and a second woven layer, a surface of the second woven layer positioned adjacent to a surface of the first woven layer to define a space between the first woven layer and the second woven layer; and a single-layer second woven zone integrally woven with the first woven layer and the second woven layer of the first woven zone and having a plurality of apertures, each aperture of the plurality of apertures located at a center of a repeating pattern of interlacings, the repeating pattern of interlacings comprising:

a first quadrant having at least one float on a first face of the woven, the at least one float formed from a first filling yarn extending across three or more consecutive warp yarns in the first quadrant and on the first face, a second quadrant having at least one float on the first face formed from a first warp yarn, a third quadrant having at least one float on the first face formed from a second filling yarn, and a fourth quadrant having at least one float on the first face formed from a second warp yarn, wherein the first quadrant and the third quadrant are positioned diagonal with respect to one another and are separated by a respective aperture of the plurality of apertures, and wherein the second quadrant and the fourth quadrant are positioned diagonal with respect to one another and are separated by the respective aperture of the plurality of apertures.

2. The woven textile of claim 1, wherein, the fourth quadrant comprises at least one float on a second face, which is opposite the first face, the at least one float on the second face formed from the second filling yarn.

3. The woven textile of claim 1, wherein the first quadrant includes a third filling yarn and a fourth filling yarn that are adjacent to the first filling yarn and that interlace with the three or more consecutive warp yarns.

4. The woven textile of claim 3, wherein the plurality of warp yarns comprises 75 denier, 72 filament yarns, and wherein each of the first plurality of filling yarns and the second plurality of filling yarns comprise 50 denier, 72 filament yarns.

5. The woven textile of claim 3, wherein the plurality of warp yarns, the first plurality of filling yarns, and the second plurality of filling yarns comprise draw texturized yarns (DTY).

6. The woven textile of claim 1, wherein the first warp yarn is floated relative to three or more consecutive filling yarns in the second quadrant.

7. The woven textile of claim 1, wherein the second filling yarn is floated relative to three or more consecutive warp yarns in the third quadrant.

8. The woven textile of claim 1, wherein the first filling yarn forms, in the second quadrant, a second float on a second face, which is opposite the first face, the second float extending across three or more consecutive warp yarns.

9. The woven textile of claim 1, wherein, in the first quadrant, the first filling yarn is floated on the first face relative at least six consecutive warp yarns.

10. The woven textile of claim 1, wherein the woven textile comprises a plurality of the first woven zone and further comprises a plurality of the second woven zone.

* * * * *